United States Patent [19]

Resch, III

[11] Patent Number: 4,908,666

[45] Date of Patent: Mar. 13, 1990

[54] APPARATUS FOR CONTROLLING TONER REPLENISHMENT IN ELECTROSTATOGRAPHIC PRINTER

[75] Inventor: William A. Resch, III, Pittsford, N.Y.

[73] Assignee: Eastman Kodak Company, Rochester, N.Y.

[21] Appl. No.: 236,481

[22] Filed: Aug. 25, 1988

[51] Int. Cl.[4] ..... G03G 15/08

[52] U.S. Cl. ..... 355/246; 118/689

[58] Field of Search ..... 355/208, 214, 246, 326; 118/665, 688–691

[56] References Cited

U.S. PATENT DOCUMENTS

| | | | |
|---|---|---|---|
| 4,226,525 | 10/1980 | Sakamoto et al. | 355/14 D |
| 4,468,112 | 8/1984 | Suzuki et al. | 355/14 D |
| 4,589,762 | 5/1986 | De Schamphelaere | 355/14 D |
| 4,607,944 | 8/1986 | Rushing | 355/14 D |

*Primary Examiner*—Joan H. Pendegrass

*Attorney, Agent, or Firm*—Milton S. Sales

[57] ABSTRACT

A toner replenishment control structure operates optimally for developer materials which exhibit toning contrast characteristics which vary predictably with the concentration of toner particles in the developer mix, and for developer materials which do not exhibit predictable changes in toning contrast as the toner concentration changes. An electrostatographic machine produces a contrast signal having a value proportional to toning contrast and a concentration signal having a value indicative of the ratio of toner to carrier in the mix, the concentration signal being substantially insensitive to the toning contrast. The system has a first state for actuating replenishment of toner of the first type according to the value of said contrast signal and a second state for actuating replenishment of toner of the second type according to the value of said concentration signal.

19 Claims, 4 Drawing Sheets

APPARATUS FOR CONTROLLING TONER REPLENISHMENT IN ELECTROSTATOGRAPHIC PRINTER

CROSS-REFERENCE TO RELATED APPLICATION

Reference is made to co-pending, commonly assigned U.S. patent application Ser. No. 052,632 filed in the name of William A. Resch, III on May 21, 1987 U.S. Pat. No. 4,847,659.

BACKGROUND OF THE INVENTION

1. Field of the Invention

This invention relates to the field of electrostatography and, more particularly, to improvements in apparatus for controlling toner replenishment.

2. Description of Prior Art

In electrostatography, electrostatic images formed on a dielectric recording element are rendered visible via the application of pigmented, thermoplastic particles known as toner. Typically, such toner forms part of a two-component developer mix consisting of the toner particles and magnetically-attractible carrier particles to which the toner particles adhere via triboelectric forces. During the development process, the electrostatic forces associated with the latent image act to strip the toner particles from their associated carrier particles, and the partially denuded carrier particles are returned to a reservoir.

It is well known in the art to continuously monitor the toner concentration in an electrostatographic developer mix and to replenish the mixture with toner when the concentration thereof falls below a predetermined level. Such a toner concentration monitor can be easily calibrated to compensate for toner depletion from the development system regardless of cause. Its significant drawback is that it is relatively slow to respond to abrupt changes in toner depletion rate, such as occasioned by a change in the image content of the documents being printed from ones having little image information thereon, to ones having large solid or continuous tone image areas. Typically, several minutes will elapse before the toner concentration is restored to a level at which copies of a desired image density can be obtained. According to U.S. Pat. No. 4,468,112, such methods are unable to maintain the toner concentration at an appropriate level over a prolonged period, as they are apt to be influenced by the spent toner particles which are present in the developer but do not contribute to the developing process. Also such methods, not based on the direct measurement of the developed image density, are unable to compensate for changes in the characteristics of the recording element due to atmospheric conditions and prolonged use.

It is also known in the art to continuously monitor toner depletion from an electrostatographic development station by monitoring the amount of toner applied to the recording member during development. For example, in the commonly assigned U.S. Pat. No. 3,674,353 issued to Trachtenberg, a pair of induction plates, positioned adjacent the recording member on the upstream and downstream sides of the development station, function to sense the overall charge on the recording member before and after development. The difference in charge induced on the plates by the passage of the undeveloped and developed charge patterns has been found to be an accurate measure of the quantity of toner depleted from the development station. A toner depletion signal, proportional to the difference in charge induced on the induction plates, is used to control toner replenishment.

Another method for continuously monitoring toner depletion from a development station is useful in electronic printers. The replenishing rate is adjusted in response to the number of character print signals applied to the print head. The print signals may be in character code and a statistical average take-out rate used to estimate toner depletion, or the signals may be picture elements (pixel) signals. See for example U.S. Pat. Nos. 3,529,546 and No. 4,413,264.

While such toner depletion monitors are quicker to respond than are toner concentration monitors, their use for controlling toner replenishment has certain disadvantages. Any toner depletion aside from that caused by image development, such as for example toner depletion caused by dusting and other losses, is not sensed by a depletion monitor, and hence will not be replenished. Nor can such a monitor detect and cure inaccuracies or defects in the toner replenishment process itself. In short, toner depletion monitors are difficult, at best, to calibrate for precise control of toner replenishment.

Co-pending, commonly assigned U.S. patent application Ser. No. 052,632 filed in the name of William A. Resch, III on May 21, 1987, discloses a toner replenishment control apparatus which overcomes the aforementioned disadvantages of prior art systems. A toner depletion signal is produced having a value indicative of the rate of toner usage. A replenishment controller actuates toner replenishment proportionally in accordance with the value of the depletion signal. A second signal is produced having a value proportional to toning contrast; and the constant of proportionallity between the toner depletion signal and the replenishment is adjusted according to the second signal.

While the control apparatus disclosed in said Application Ser. No. 052,632 is excellent for electrostatographic machines having traditional developer materials which exhibit toning contrast characteristics which vary predictably with the concentration of toner particles in the developer mix, new developer materials are becoming commercially available which do not exhibit predictable changes in toning contrast as the toner concentration changes.

Fortunately, the toning contrast characteristics of these new developer materials do not exhibit large changes with changes in environmental conditions, and it is therefore not necessary to adjust the replenishment rate according to the toning contrast characteristics for these materials. However, it is likely that both traditional developer materials and the new type of developer materials may be used in the same machine; even for the development of a single reproduction. For example, a color reproduction is formed by developing several color-separation latent images and transferring the developed images in succession to a single receiver sheet. Black portions of the image may be produced by adding red, blue, and green toners in equal amount (called process black) but is more commonly produced by using a fourth color station with black toner (called toner black). If the red, blue, and green toner was of the traditional type and the black toner was of the new type, the replenishment scheme for the different material types must be different for optimum results.

SUMMARY OF THE INVENTION

In view of the foregoing discussion, an object of this invention is to provide a toner replenishment control apparatus which overcomes the aforementioned disadvantages of prior art systems.

The apparatus of the present invention comprises toner replenishment control structure which operates optimally for developer materials which exhibit toning contrast characteristics which vary predictably with the concentration of toner particles in the developer mix, and for developer materials which do not exhibit predictable changes in toning contrast as the toner concentration changes.

An electrostatographic machine according to the present invention comprises means for contrasting an electrostatic image-bearing member with a development mix of toner and carrier particles wherein the toner is selectable from a first type which exhibits toning contrast characteristics which vary predictably with changes in the concentration of toner particles in the developer mix and a second type which does not exhibit predictable changes in toning contrast as the toner concentration changes. Means are provided for replenishing the toner in the mix. A contrast signal is produced having a value proportional to toning contrast. Replenishment activating means has a first state for actuating replenishment of toner of the first type according to the value of the contrast signal and a second state for actuating replenishment of toner of the second type according to other than the value of the contrast signal.

In accordance with another feature of the present invention, means are provided for producing a concentration signal having a value indicative of the ratio of toner to carrier in the mix, the concentration signal being substantially insensitive to the toning contrast. The second state of the replenishment activating means actuates replenishment of toner of the second type according to the value of said concentration signal.

According to a first preferred embodiment of the present invention, an electrostatographic machine is provided with means for producing a toner concentration signal, and means for producing a toner depletion signal. Toner which exhibits predictable changes in toning contrast with concentration is replenished according to the value of the depletion signal, and toner which does not exhibit predictable changes in toning contrast with concentration is replenished according to the value of at least the concentration signal. Preferably, a contrast signal is produced having a value proportional to toning contrast, and the contrast signal value is used for adjusting the constant of proportionallity between the rate of toner usage and the depletion signal value. It is also preferred that toner which does not exhibit predictable changes in toning contrast with concentration is replenished according to the sum of the depletion signal and the concentration signal.

In another expression of the first preferred embodiment of the invention, an electrostatographic machine includes means for contacting an electrostatic image-bearing member with a development mix of toner and carrier particles, wherein the toner is selectable from a first type and a second type. A contrast signal is produced having a value related to the toning contrast of the machine, a concentration signal is produced having a value indicative of the ratio of toner to carrier in the mix, and a depletion signal is produced having a value indicative of the rate of toner image. The depletion signal producing means is selectively adjustable to change the response to toner usage in accordance with the contrast signal. Replenishment of toner of the first type is effected according to the value of the depletion signal, and replenishment of toner of the second type is effected according to the value of at least the concentration signal. Preferably, the machine includes a print head and means to apply character print signals to said print head; wherein the depletion signal is proportional to the number of character print signals applied to the print head.

In yet another expression of the first preferred embodiment of the invention, an electrostatographic machine includes a recording member having image areas, means for substantially uniformly charging the recording member to a primary voltage, means for imagewise exposing the charged recording member to produce discrete latent charge images, and means, including a biased electrode, for developing the latent charge images with toner selectable from a first type and a second type; the electrode bias, the exposure level, and the primary voltage being process control parameters. At least one of the process control parameters are controlled for a given image area to adjust the maximum output image density $D_{max}$. A toner depletion signal is proportionally converted to a replenishment control signal. For the given image area, the value of the said at least one of the controlled process control parameters is compared to a predetermined target value to produce a difference signal. The constant of proportionallity of the converting means is adjusted in response to the difference signal. A toner monitor produces a concentration signal having a value indicative of the ratio of toner to carrier in the mix. Replenishment of toner of the first type is effected according to the value of the depletion signal and replenishment of toner of the second type is effected according to the value of at least the concentration signal.

In accordance with a second preferred embodiment of the present invention, an electrostatographic machine is provided with means for producing an actual toner concentration signal, means for producing a predetermined target toner concentration signal, and means for producing a contrast signal having a value proportional to toning contrast. Toner which exhibits predictable changes in toning contrast with concentration is replenished according to the value of a comparison between the actual toner concentration signal and the contrast signal. Toner which does not exhibit predictable changes in toning contrast with concentration is replenished according to a comparison between the actual toner concentration signal and the target toner concentration signal.

The invention and its various disadvantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein.

DESCRIPTION OF THE PREFERRED EMBODIMENTS

Figure 1:
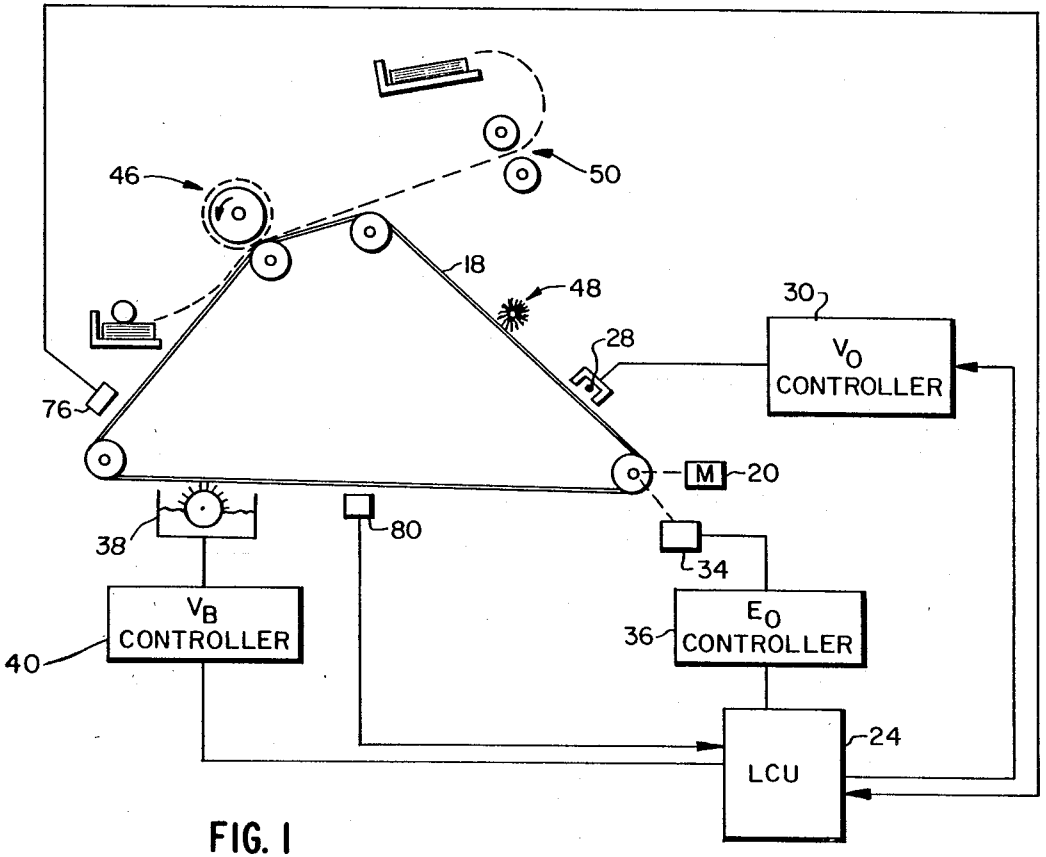
FIG. 1 is a schematic showing a side elevational view of an electrostatographic machine in accordance with a preferred embodiment of the invention.

To facilitate understanding of the foregoing, the following terms are defined:

$V_B$=Development station electrode bias.

$V_O$=Primary voltage (relative to ground) on the photoconductor just after the charger. This is sometimes referred to as the "initial" voltage.

$V_F$=Photoconductor voltage (relative to ground) just after exposure.

$E_O$=Light produced by the print head.

E=Actual exposure of photoconductor. Light $E_O$ produced by the print head illuminates the photoconductor and causes a particular level of exposure E of the photoconductor.

Contrast and density control is achieved by the choice of the levels of $V_O$, $E_O$, and $V_B$. For a detailed explanation of the theory of printer contrast and exposure control by controlling initial voltage, exposure, and bias voltage, reference may be made to the following article: Paxton, Electrophotographic Systems Solid Area Response Model, 22 Photographic Science and Engineering 150 (May/June 1978).

Another term used herein is "toning contrast", by which is meant the ratio of the output maximum density $D_{max}$ to the absolute value of the difference between $V_B$ and $V_F$ corresponding to a region of maximum density.

A moving recording member such as photoconductive belt 18 is driven by a motor 20 past a series of work stations of the printer. A logic and control unit (LCU) 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_O$ to the surface of the belt. The output of the charger is regulated by a programmable controller 20, which is in turn controlled by LCU 24 to adjust primary voltage $V_O$.

At an exposure station 34, may be optical or electronic. In the illustrated electronic embodiments, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element with an intensity regulated by a programmable controller 36 as determined by LCU 24.

Travel of belt 18 brings the areas bearing the latent charge images into a development station 38. The development station is illustrated with only one magnetic brush for clarity. However, it will be understood that each color toner, including black, has its own magnetic brush in juxtaposition to, but spaced from, the travel path of the belt. Magnetic brush development stations are well known. For example, see U.S. Pat. No. 4,473,029 to Fritz et al and 4,546,060 to Miskinis et al.

LCU 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40.

A transfer station 46 and a cleaning station 48 are both fully described in commonly assigned U.S. Pat. Application Ser. No. 809,546, filed Dec. 16, 1985. After transfer of the unfixed toner images to a receiver sheet, such sheet is transported to a fuser station 50 where the image is fused.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
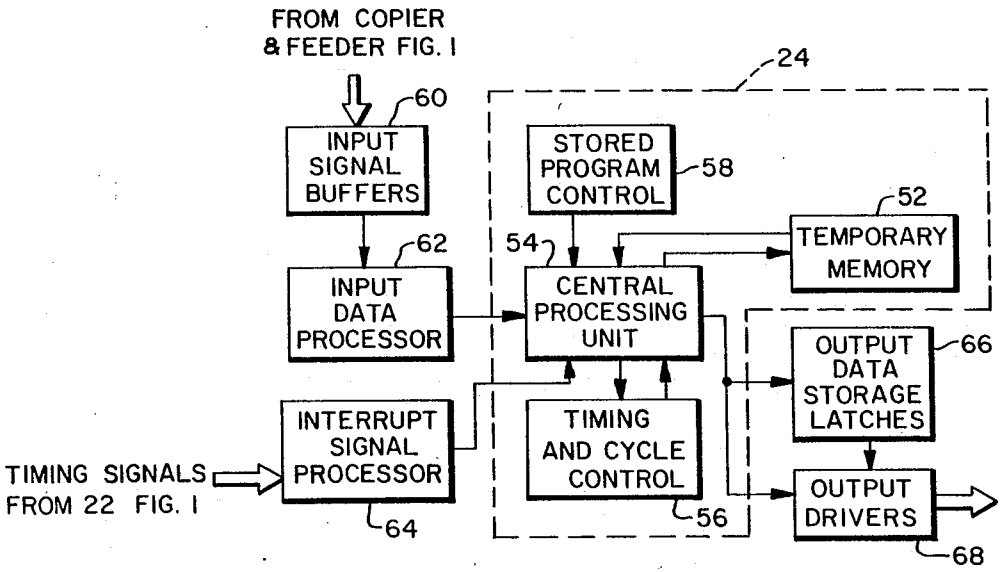
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Feedback Control

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of an estimate of toned density. This signal may be used to adjust $V_O$, $E_O$, $V_B$; and, as explained below, to assist in the maintenance of the proper concentration of toner particles in the developer mixture.

Figure 3:
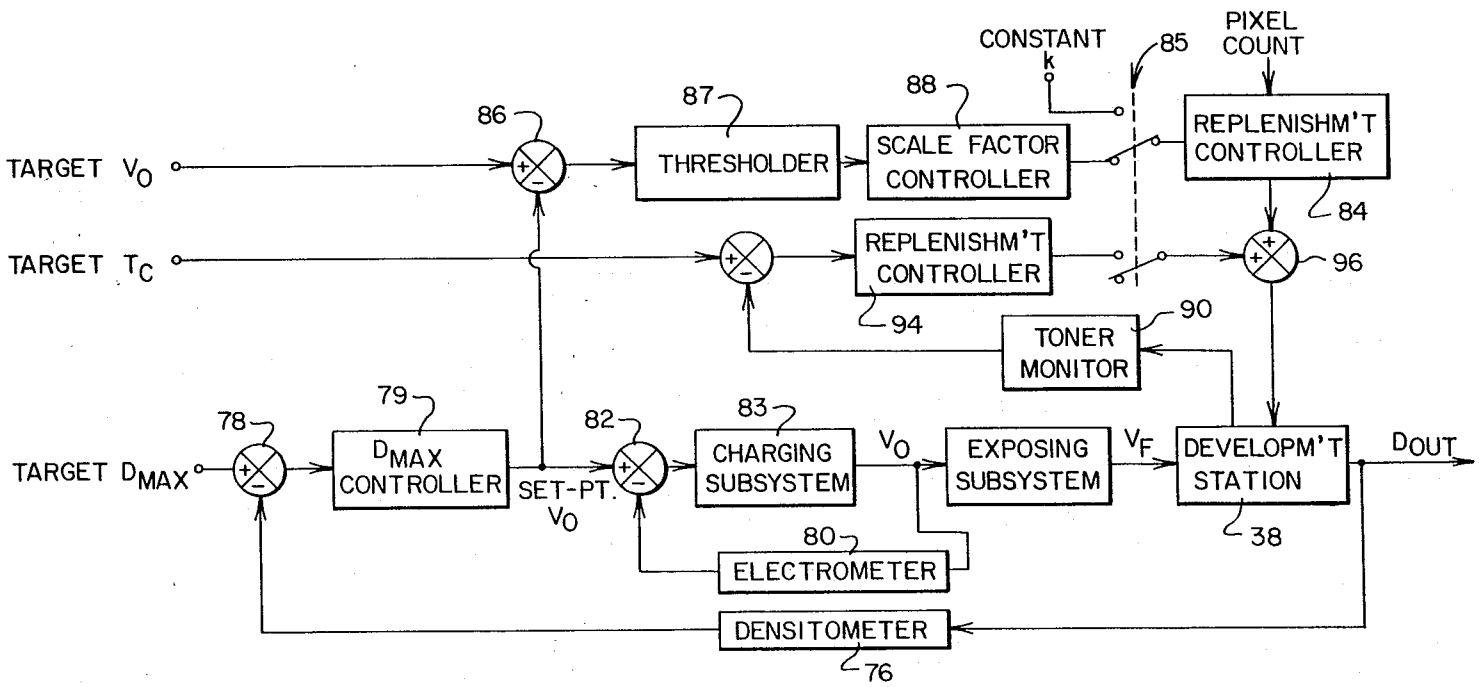
FIG. 3 is a diagram of a first embodiment of the process for deriving a development station replenishment control signal for the electrostatographic machine of FIG. 1.

In the preferred embodiment illustrated in FIG. 3, the density signal is used to control primary voltage $V_O$.

The output of densitometer 76, upon being suitably amplified, is compared at 78 to a reference signal value "Target $D_{max}$" representing a desired maximum density output level.

The output of comparator 78 may be fed to standard proportional and integral controller 79 which produces an output signal having a first component proportional to its input and a second component proportional to the integral of its output. The integral term assures that there will be a zero steady-state error for any constant rate of toner depletion. The output of proportional and integral controller 79 is referred to herein as the "Set-Point $V_0$".

The actual post-charging film voltage $V_O$ is measured by an electrometer 80, and is compared to Set-Point $V_O$ at 82 to produce a signal for adjusting $V_O$ controller 30 (FIG. 1) of charging subsystem 83 to obtain proper density for the next frame. Primary voltage controller 30 is also of the proportional and integral type.

Replenishment

Still referring to FIG. 3, a proportional replenishment controller 84 receives a toner depletion signal indicative of the rate of toner usage. The usage signal may be an indication of the number of sheets printed or the number of characters, but preferably is a count of the number of pixels to be toned.

Ganged switch means 85 is configured as illustrated in FIG. 3 when using traditional developer materials which exhibit toning contrast characteristics which vary predictably with the concentration of toner particles in the developer mix. Switch means 85 is in it's non-illustrated position when developer materials which do not exhibit predictable changes in toning contrast as the toner concentration changes are in use.

In the short term, replenishment controller 84 reacts proportionally to the pixel count, or other toner depletion signal, to create a replenishment control signal. However, the toning contrast of traditional developer materials is fairly dependent on environmental conditions and prolonged use of the recording element. Therefore, when such materials are in use, the constant of proportionallity of replenishment controller 84 may require occasional adjustment to prevent long term accumulated error from causing variations from acceptable toner concentration in the developer mix. Such error could result from inaccuracies, material life, or environmental effects.

Any offset between the Set-Point $V_O$ signal and a Target $V_O$ signal, as determined by a comparator 86, would be caused by errors in the replenishment rate resulting in changes in the toning contrast. That is, a change in the Set-Point $V_O$ value reflects a change in toning contrast (i.e., variation in $D_{out}$ from $D_{max}$). When the absolute difference between Set-Point $V_O$ and Target $V_O$ exceeds a predetermined value as determined by a thresholder 87, a scale factor controller 88 adjusts the value of the controller 84 constant of proportionallity relating the toner usage signal to the amount of toner expedited to be consumed.

Scale factor controller 88 is a proportional and integral (reverse) controller which fine tunes the constant of proportionallity used to convert pixel counts into toner utilization, while replenishment controller 84 is a proportional-only (direct) controller. The reverse action of controller 88 arises from the interpretation of a positive error signal at the output summing junction 86 as indicating a need to reduce the replenishment scale factor. As this is accomplished, Set-Point $V_O$ increases, and the error signal is reduced.

The toning contrast of non-traditional developer materials is less dependent on environmental conditions and prolonged use of the recording element. Therefore, when such materials are in use, the constant of proportionallity of replenishment controller 84 does not generally require adjustment from factory setting. Therefore, switching means 85 assumes its non-illustrated state for such materials, wherein a present constant of proportionallity is used to convert pixel counts into a toner depletion signal.

However, if the toning contrast cannot be used to maintain proper toner concentration in development station 38, there must be other means provided to inhibit small errors in replenishment controller 84 or the selected constant of proportionallity from compounding and accumulating. A toner monitor 90 creates a signal representative of the concentration of toner particles to carrier particles in the development mixture. That toner concentration signal is compared at 92 to a predetermined target toner concentration signal, and the difference is inputted to a second replenishment controller 94. Replenishment controller 94 receives the toner concentration error signal and reacts proportionally to create a second replenishment control signal.

The replenishment control signals from controllers 84 and 94 are algebraically summed at 96 to produce a control signal for controlling toner replenishment. Combining the respective outputs of controllers 84 and 94 inhibits inaccuracies of either from having any great effect on the system.

When traditional developer materials which exhibit toning contrast characteristics which vary predictably with the concentration of toner particles in the developer mix are in use, switch means 85 is in its illustrated state, and the output of replenishment controller 94 does not affect the rate of replenishment.

Figure 4:
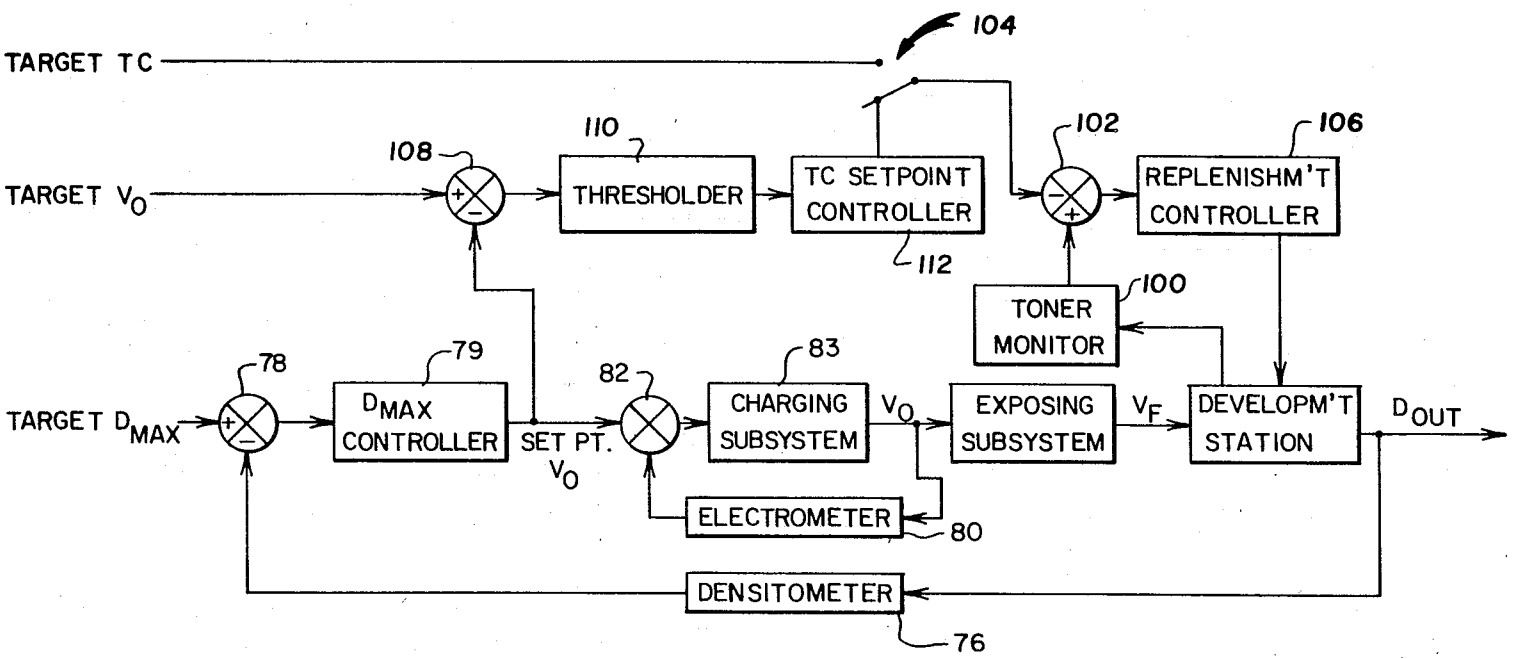
FIG. 4 is a diagram of a second embodiment of the process for deriving a development station replenishment control signal for the electrostatographic machine of FIG. 1.

Referring to FIG. 4, and the second embodiment of the present invention shown therein, a toner monitor 100 creates a signal representative of the concentration of toner particles to carrier particles in the development mixture. That toner concentration signal is compared at 102 to either a toner concentration set-point signal when switch means 104 is in its illustrated state or a target toner concentration signal when switch means 104 is in its non-illustrated position.

Switch means 104 is in its illustrated state when using traditional developer materials which exhibit toning contrast characteristics which vary predictably with the concentration of toner particles in the developer mix. Switch means 104 is in it's non-illustrated state when developer materials which do not exhibit predictable changes in toning contrast as the toner concentration changes are in use.

The difference signal from comparator 102 is inputted to a replenishment controller 106. In the short term, replenishment controller 106 reacts proportionally to the toner concentration signal from monitor 100 to create a replenishment control signal. However, the toning contrast of traditional developer materials is fairly dependent on environmental conditions and prolonged use of the recording element. Therefore, when such materials are in use, the target toner concentration signal to comparator 102 may require occasional adjustment to prevent long term accumulated error from causing variations from acceptable toner concentration in the developer mix. Such error could result from inaccuracies, material life, or environmental effects.

Any offset between the Set-Point $V_O$ signal and a Target $V_O$ signal, as determined by a comparator 108, would be caused by errors in the replenishment rate resulting in changes in the toning contrast. That is, a change in the Set-Point $V_O$ value reflects a change in toning contrast (i.e., variation in $D_{out}$ from $D_{max}$). When the absolute difference between Set-Point $V_O$ and Target $V_O$ exceeds a predetermined value as determined by a thresholder 110, a toner concentration set-point controller 112 adjusts the value inputted to comparator 102.

The toning contrast of non-traditional developer materials is less dependent on environmental conditions and prolonged use of the recording element. Therefore, when such materials are in use, the reference value inputted to comparator 102 does not generally require adjustment from factor setting. Therefore, switching means 104 assumes its non-illustrated state for such materials, wherein a present target toner concentration is used for comparison with the measured toner concentration at the development station.

The invention has been described in detail with particular reference to preferred embodiments thereof, but it will be understood that variations and modifications can be effected within the spirit and scope of the invention. For example, the algorithms of the preferred embodiments are suitable for computing a replenishment control signal based on primary voltage $V_O$ measurements. However, one might choose to use exposure parameter $E_O$ or development bias parameter $V_B$ rather than film voltage parameter $V_O$ parameters.

What is claimed is:

1. An electrostatographic machine comprising:

means for contacting an electrostatic image-bearing member with a development mix of toner and carrier particles, wherein the toner is selectable from a first type which exhibits toning contrast characteristics which vary predictably with changes in the concentration of toner particles in the developer mix and a second type which exhibits unpredictable changes in toning contrast as the toner concentration changes;

means for replenishing the toner in the mix;

means for producing a contrast signal having a value proportional to toning contrast;

means for producing a second signal having a value characteristic of a condition of the development mix; and means having a first state for actuating replenishment of toner of the first type according to the value of said contrast signal and a second state for actuating replenishment of toner of the second type according to the value of said second signal.

2. An electrostatographic machine comprising:

means for contacting an electrostatic image-bearing member with a development mix of toner and carrier particles, wherein the toner is selectable from a first type which exhibits toning contrast characteristics which vary predictably with changes in the concentration of toner particles in the developer mix and a second type which exhibits unpredictable changes in toning contrast as the toner concentration changes;

means for replenishing the toner in the mix;

means for producing a contrast signal having a value proportional to toning contrast;

means for producing a concentration signal having a value indicative of the ratio of toner to carrier in the mix, said concentration signal being substantially insensitive to the toning contrast; and means having a first state for actuating replenishment of toner of the first type according to the value of said contrast signal and a second state for actuating replenishment of toner of the second type according to the value of said concentration signal.

3. An electrostatographic machine comprising:

means for contacting an electrostatic image-bearing member with a development mix of toner and carrier particles, wherein the toner is selectable from a first type which exhibits toning contrast characteristics which vary predictably with changes in the concentration of toner particles in the developer mix and a second type which exhibits unpredictable changes in toning contrast as the toner concentration changes;

means for replenishing the toner in the mix; means for producing a concentration signal having a value indicative of the ratio of toner to carrier in the mix;

means for producing a depletion signal having a value indicative of the rate of toner usage; and means having a first state for actuating replenishment of toner of the first type according to the value of said depletion signal and a second state for actuating replenishment of toner of the second type according to the value of at least said concentration signal.

4. An electrostatographic machine as set forth in claim 3 further comprising;

means for producing a contrast signal having a value proportional to toning contrast; and means, responsive to said contrast signal value, for adjusting the constant of proportionallity between the rate of toner usage and the depletion signal value.

5. An electrostatographic machine as forth in claim 3 wherein the second state of said actuating means actuates replenishment according to the sum of said depletion signal and said concentration signal.

6. An electrostatographic machine as set forth in claim 3 further comprising; means for producing a contrast signal having a value proportional to toning contrast; and means, responsive to said contrast signal value, for adjusting the constant of proportionallity between the rate of toner usage and the depletion signal value only when said actuating means is in its first state.

7. An electrostatographic machine comprising;

means for contacting an electrostatic image-bearing member with a development mix of toner and carrier particles, wherein the toner is selectable from a first type and a second type;

means for replenishing the toner in the mix;

means for producing a contrast signal having a value related to the toning contrast of the machine;

a toner monitor which produces a concentration signal having a value indicative of the ratio of toner to carrier in the mix;

means for producing a depletion signal having a value indicative of the rate of toner usage, said depletion signal producing means being selectively adjustable to change the response to toner usage in accordance with said contrast signal; and means having a first state for actuating replenishment of toner of the first type proportionally according to the value of said depletion signal and a second state for actuating replenishment of toner of the second type proportionally according to the value of at least said concentration signal.

8. An electrostatographic machine as defined in claim 7 wherein;

said machine further includes a print head and means to apply character print signals to said print head; and said depletion signal is proportional to the number of character print signals applied to the print head.

9. An electrostatographic machine as defined in claim 8 wherein said characters are pixels to be toned.

10. An electrostatographic machine comprising;

a recording member having image areas;

means for substantially uniformly charging said recording member to a primary voltage;

means for imagewise exposing the charged recording member to produce discrete latent charge images;

means, including a biased electrode, for developing the latent charge images with toner selectable from a first type and a second type; the electrode bias, the exposure level, and the primary voltage being process control parameters;

means for controlling at least one of the process control parameters for a given image area to adjust the maximum output image density $D_{max}$;

means for producing a depletion signal;

means for proportionally converting the depletion signal to a replenishment control signal;

means, for the given image area, for comparing the value of said at least one of the controlled process control parameters to a predetermined target value to produce a difference signal;

means for adjusting the constant of proportionallity of the converting means in response to the difference signal;

a toner monitor which produces a concentration signal having a value indicative of the ratio of toner to carrier in the mix; and means having a first state for actuating replenishment of toner of the first type proportionally according to the value of said depletion signal and a second state for actuating replenishment of toner of the second type proportionally according to the value of at least said concentration signal.

11. An electrostatographic machine as set forth in claim 10 wherein the second state of said actuating means actuates replenishment according to the sum of said depletion signal and said concentration signal.

12. An electrostatographic machine as set forth in claim 10 wherein said means for adjusting the constant of proportionallity between the rate of toner usage and the depletion signal value only when said actuating means is in its first state.

13. An electrostatographic machine as defined in claim 10 wherein;

said machine further includes a print head and means to apply character print signals to said print head; and said depletion signal is proportional to the number of character print signals applied to the print head.

14. An electrostatographic machine as defined in claim 10 wherein said adjusting means is a proportional and integral controller.

15. An electrostatographic machine comprising:

means for contacting an electrostatic image-bearing member with a development mix of toner and carrier particles, wherein the toner is selectable from a first type which exhibits toning contrast characteristics which vary predictably with changes in the concentration of toner particles in the developer mix and a second type which exhibits unpredictable changes in toning contrast as the toner concentration changes;

means for replenishing the toner in the mix;

means for producing an actual concentration signal having a value indicative of the ratio of toner to carrier in the mix;

means for producing a predetermined target toner concentration signal;

means for producing a contrast signal having a value proportional to toning contrast; and means having (1) a first state for actuating replenishment of toner of the first type according to a comparison between said actual toner concentration signal and said contrast signal and (2) a second state for actuating replenishment of toner of the second type according to a comparison between said actual toner concentration signal and said target toner concentration signal.

16. An electrostatographic machine as set forth in claim 15 where said means for producing a contrast signal includes means for comparing the primary voltage required to maintain substantially constant output reproduction density to a target primary voltage value.

17. An electrostatographic machine as set forth in claim 15 where said means for producing a contrast signal includes:

means for comparing the primary voltage required to maintain substantially constant output reproduction density to a target primary voltage value; and means for producing a toner concentration set-point from the comparison of the primary voltage and the target primary voltage.

18. An electrostatographic machine as set forth in claim 15 wherein said means for producing a contrast signal includes means for comparing the value of a process control parameter required to maintain substantially constant output reproduction density to a target value.

19. An electrostatographic machine as set forth in claim 15 wherein said means for producing a contrast signal includes:

means for comparing the value of a process control parameter required to maintain substantially constant output reproduction density to a target value; and means for producing a toner concentration set-point from the comparison of the process control parameter and its target value.

* * * * *